US005148188A

United States Patent [19]

Ota et al.

[11] Patent Number: 5,148,188

[45] Date of Patent: Sep. 15, 1992

[54] THERMAL HEAD

[75] Inventors: Shigenori Ota, Aira; Masataka Uchiyama; Tsuyoshi Yasutomi, both of Kokubu, all of Japan

[73] Assignee: Kyocera Corporation, Kyoto, Japan

[21] Appl. No.: 525,132

[22] Filed: May 17, 1990

[30] Foreign Application Priority Data

Aug. 31, 1989 [JP] Japan ..... 1-226856

[51] Int. Cl.[5] ..... B41J 2/325

[52] U.S. Cl. ..... 346/76 PH

[58] Field of Search ..... 346/76 PH

[56] References Cited

FOREIGN PATENT DOCUMENTS

| | | | |
|---|---|---|---|
| 0008082 | 1/1985 | Japan | 346/76 PH |
| 0027265 | 2/1986 | Japan | 346/76 PH |
| 0064463 | 4/1986 | Japan | 346/76 PH |
| 0297161 | 12/1987 | Japan | 346/76 PH |

*Primary Examiner*—Joseph W. Hartary

*Assistant Examiner*—Huan Tran

*Attorney, Agent, or Firm*—Spensley Horn Jubas & Lubitz

[57] ABSTRACT

To the common electrode of the thermal head, the power source for heating and driving is connected to one end or both ends in the longitudinal direction of the common electrode. In this common electrode, as going from the connecting position of the power source for heating and driving, a voltage drop occurs, and the heat generation by the heating elements commonly connected to the common electrodes becomes uneven. Such uneven heat generation may lead to uneven contrast or defective coloring in the thermosensitive printing. The invention employs a conductive member which extends nearly over the entire length of the common electrode, and contacts with the common electrode over the entire length or at plural positions. As such conductive member, a metal foil or the like is used, and by inhibiting the occurrence of voltage drop, thermosensitive printing of high quality is realized.

15 Claims, 12 Drawing Sheets

THERMAL HEAD

BACKGROUND OF THE INVENTION

1. Field of the Invention

The present invention relates to a thermal head.

2. Description of the Prior Art

FIG. 1 is a plan view of a thermal head 1 of a typical prior art, and FIG. 2 is a magnified perspective view of the thermal head 1. Referring to these drawings, the prior art is described. Plural heating elements 3 are linearly arranged on an electrically insulating substrate 2, and a heating element line 16 is composed. One end of the common side of the heating element line 16 is commonly connected to a common electrode line 4, and the other common end is connected to plural driving circuit elements 6 through individual electrodes 5 formed on every heating element 3. An electric power is supplied to the driving circuit elements 6 from a power circuit element 8 through a power supply line 7.

The common electrode line 4 is connected to a pair of power circuit elements 8. Part of the power circuit elements 8 and power supply line 7 is mounted on a flexible wiring board 9. A control line 10 for generating heat by selectively energizing the heating elements 3 is connected to each driving circuit element 6. Such substrate 2 is mounted on a cooling board 11 made of, for example, metal material.

In such a thermal head 1, the common electrode lines 4 are made of same material as individual electrodes 5, and are formed simultaneously with the individual electrodes 5, and comprise thin film parts 12 formed in a thickness of several micrometers or less by thin film technology, and thick film parts 13 commonly combined with thin film parts 12 at every heating element 3, stretching over the entire length in the arraying direction of the heating elements 3, having one end connected to the power circuit element 8, and formed by thick film technology such as screen printing. The portion of the thick film parts 13 opposite each heating element 3 is formed in a width of W1, overall length of L1 and film thickness of D1 (20 to 30 $\mu$m).

If this thermal head 1 of the type for printing on recording paper of A4 size according to the Japanese Industrial Standard, the length L1 of the thick film part 13 is about 232 mm. In the case of the resistivity of the thick film part 13 is about 5 microohm-cm, the film thickness D1 of the thick film parts 13 is 30 $\mu$m and width W1 is 5 mm, the resistance of the middle part of the thermal head 1, that is, of near the position about 116 mm apart from the left end in FIG. 16 of the part opposite the heating elements 3 of the thick film parts 13 is about 39 milliohms. Therefore, when an electric power of 24 V, 25 A is supplied to the common electrode 4 from each power circuit element 8, the voltage drop is $$25A \times 0.039\ \Omega \approx 0.98\ V \quad (1)$$

and hence about 4.1% is lowered. By such voltage drop, unevenness occurs in the heat generation of the heating elements 3 corresponding to the parts at the closer side and the remoter side of the power circuit elements 8 of the thick film parts 13, and an uneven contrast occurs when printed, which leads to lowering of print quality.

Concerning such uneven printing due to voltage drop in the thick film parts 13, it has been confirmed, as far as the thermal head 1 is to perform high picture quality printing of gradation printing of video printer or the like, especially sublimate printing in coloring technology, that the uneven contrast may be eliminated if the voltage drop is about less than 1.5%. According to such characteristic of the thick film parts 13, in order to set the voltage drop about less than 1.5%, it is required to control the resistance of the thick film parts under 15 milliohms. To realize such resistance, however, the width W1 of the thick film parts 13 becomes more than 13 mm.

FIG. 3 is a sectional view from line III—III in the cross section of FIG. 2 for explaining the problem when the width W1 of the thick film parts 13 of the common electrodes 4 is increased. A recording paper 14 to be printed by the thermal head 1 is conveyed in the direction of arrow A1 in FIG. 3, and is cut off at a cutting position P1 remote by a predetermined distance L2 from the downstream side end in the conveying direction A1 of the cooling board 11. Therefore, when the width W1 of the thick film parts 13 increases, the distance L3 between the heating elements 3 and the cutting position P1 becomes longer. This distance L3 corresponds to an upper marginal region 15 of the printed recording paper 14. That is, the recording paper 14 is cut off at the cutting position P1, and has a upper marginal region 15 in the length L3, and is printed from the position opposite to the heating elements 3.

Hence, as the width W1 of the thick film parts 13 becomes larger, the substrate 2 on which the common electrodes 4 is formed increase in size, and the manufacturing cost rises. At the same time, the upper marginal region 15 of the recording paper 14 becomes unnecessarily large, and the running cost increases in this respect.

SUMMARY OF THE INVENTION

It is hence a primary object of the invention to solve the above-discussed technical problems, and present a thermal head capable of enhancing the printing quality and reducing the structural size.

To achieve the above object, an embodiment of the invention presents a thermal head which comprises common electrode lines connected commonly to one side of heating element line composed by arranging plural heating elements on an electrically insulating substrate, and individual electrodes respectively connected to the other side of the heating element line, wherein one side of an L-shaped conductive member is mounted on the common electrode in the longitudinal direction.

Another feature of an embodiment of the invention is that plural blanking parts are formed in the conductive member in its longitudinal direction.

According to the invention, on the heating element line composed of plural heating elements arranged on the electrically insulating substrate, the common electrode lines and individual electrode are connected mutually on the opposite sides, and a driving current is supplied. On the common electrode lines, the L-shaped conductive member is mounted in the longitudinal direction. The vicinity of one end of the L-shaped conductive member is connected to an embodiment of the common electrode line along the substantial overall length of the common electrode in the arranging direction of the heating elements, and the remaining part other than the vicinity of one end is extended, being bend in the thicknesswise direction of the substrate, and a driving current of the heating elements is supplied.

Therefore, the electric line in which the driving current flows toward the heating elements has a lower resistance than the electric line comprising only the common electrode line. It is thus possible to suppress the degree of the voltage drop when the current flows in such electric line, so that uneven temperature of heating elements and therefore uneven contrast in recording may be suppressed. Besides, since the L-shaped conductive member is bent in the thicknesswise direction of the substrate, the thermal head may be prevented from increasing in size.

Besides, in the same vicinity of one end of the L-shaped conductive member, plural blanking parts are formed along the arranging direction of the heating elements. When the common electrode lines and L-shaped conductive member are connected by using hot melt conductor, the excess portion of the hot melt conductor is put away in the blanking parts. As a result, it is possible to prevent the excess portion of the hot melt conductor from bulging out of the substrate to injure the recording paper to be recorded by the thermal head, or other undesired troubles.

According to an embodiment of the invention, thus, the L-shaped conductive member is connected to the common electrode line, and the vicinity of one end of the L-shaped conductive member is connected to the common electrode line along the substantial overall length of the common electrode in the arranging direction of the heating elements, and the other portions than this vicinity of one end are bent and extended in the thicknesswise direction of the substrate, so that a driving current of the heating elements is supplied.

Therefore, the electric line in which the driving current flows toward the heating elements is composed to have a lower resistance than in the case of common electrode alone. It is thereby possible to suppress the degree of voltage drop at the time of flow of the current in such electric line, so that the uneven temperature of the heating elements, that is, the uneven contrast in recording may be inhibited. Moreover, since the conductive member is bent in the thicknesswise direction of the substrate, the thermal head is prevented from increasing in size.

In the invention, furthermore, plural blanking parts are formed along the arranging direction of the heating elements, in the same vicinity of one end of the L-shaped conductive member. When the common electrode line and conductive member are connected by using hot melt conductor, the excess portion of the hot melt conductor when connecting is put away into the blanking parts. It is thus possible to prevent the excess portion of the hot melt conductor from bulging out of the substrate to injure the recording paper to be recorded by the thermal head, and occurrence of other undesired events.

In addition, in the invention, the thickness of the common electrode line is substantially increased in the common electrode line and individual electrodes connected respectively to one side and the other side of the heating element line arranged on the electrically insulating substrate. Therefore, when a current for heating element is supplied to the common electrode line, it is possible to suppress the degree of voltage drop caused as the current for heating elements flows in the common electrode line. It is hence possible to suppress the uneven temperature of the heating elements, as a result, the uneven contrast in thermal recording, thereby enhancing the printing quality outstandingly. Besides, the common electrode line is substantially increased in its thickness to lower the resistance, so that increase in size of thermal head due to expansion of the width of the common electrode line may be prevented.

Besides, when the blanking parts are formed, the L-shaped conductive member heated at the time of connection with the common electrode line is lowered in temperature to room temperature thereafter, but the resulting contraction stress of the L-shaped conductive member may be alleviated, so that the durability may be enhanced.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
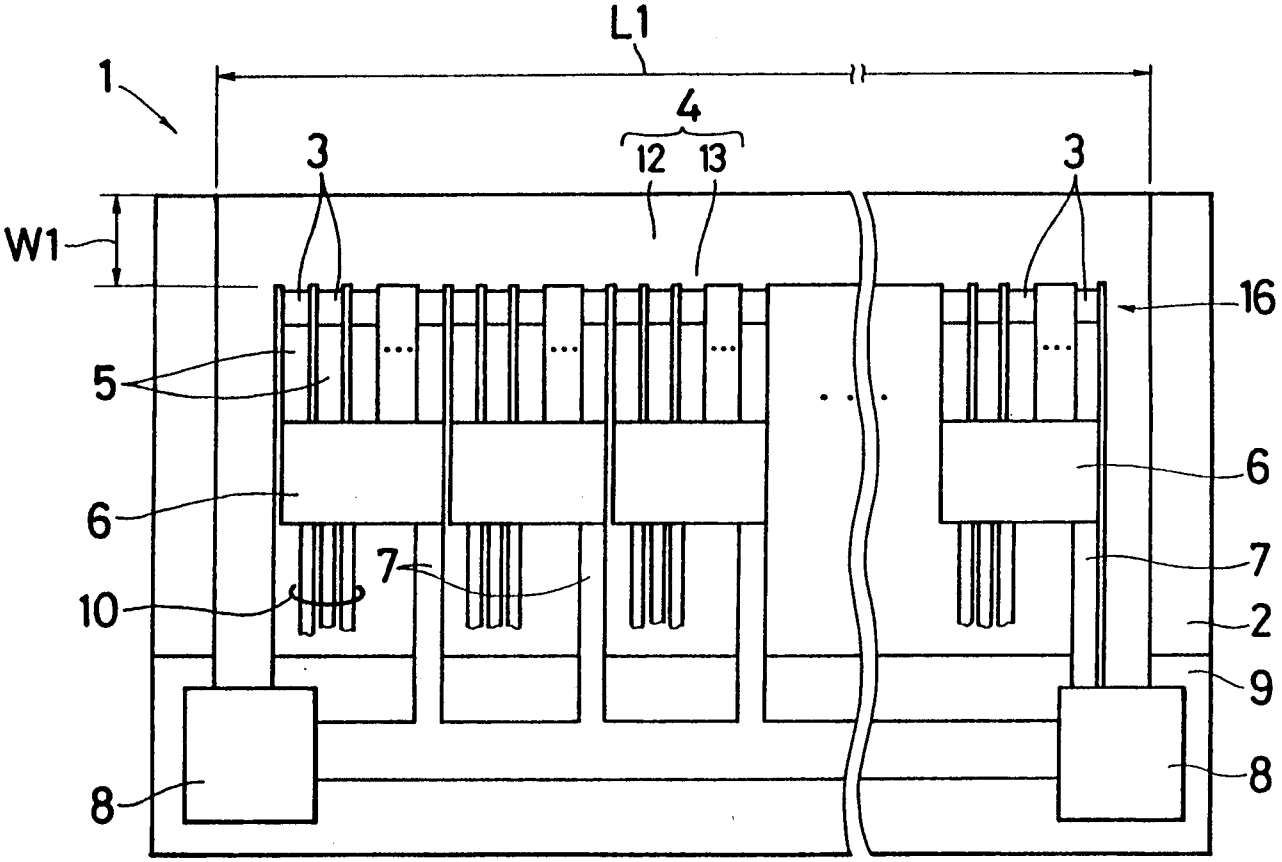
Fig. 1 Prior Art
FIG. 1,is a plan view of a thermal head 1 of a first prior art.

Now referring to the drawing, preferred embodiments of the invention are described below.

Figure 4:
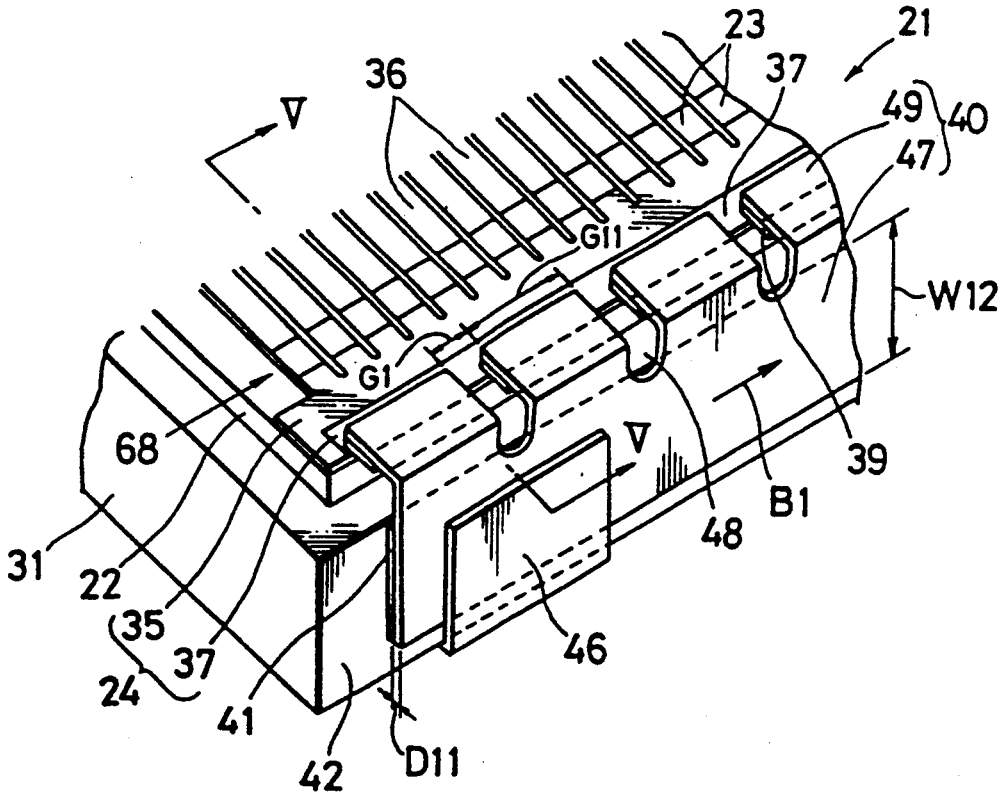
FIG. 4 is a perspective view of a thermal head 21 of a first embodiment of the invention.
Figure 5:
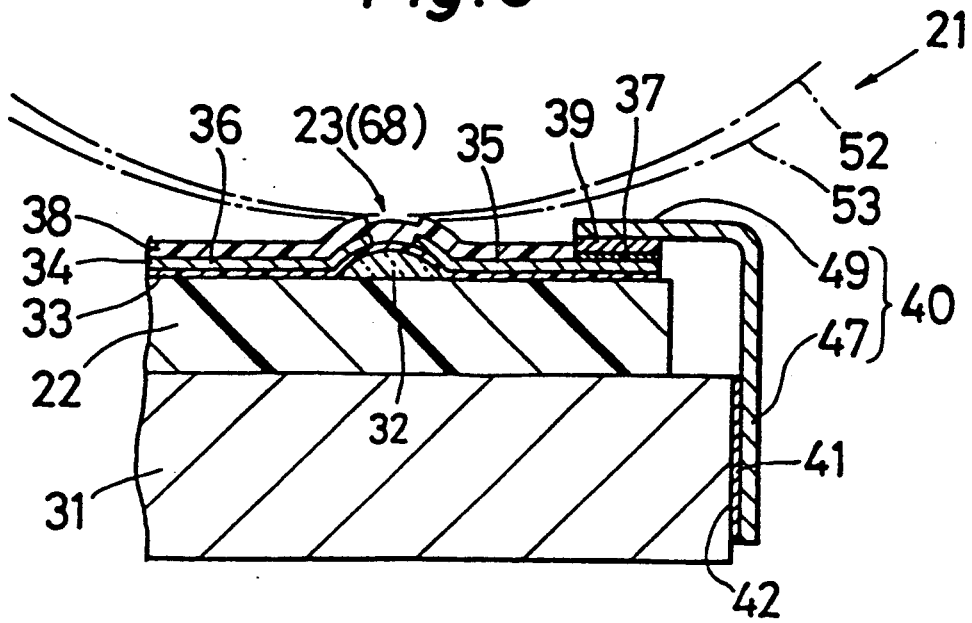
FIG. 5 is a sectional view of line V—V of cross section of FIG. 4.

FIG. 4 is a magnified perspective view of a thermal head 21 of an embodiment of the invention, and FIG. 5 is a sectional view of line V—V of the cross section of FIG. 4. In these drawings, the thermal head 21 comprises a flat-plate substrate 22 made of a material possessing both electric insulation and rigidity, such as alumina ceramic, and a heat reserve layer 32 is formed on the substrate 22 by thick film technology such as screen printing. On the heat reserve layer 32, a heating resistance element layer 33 is formed by thin film technology such as sputtering and vapor deposition. On each heating resistance layer 33, a thin film electrode layer 34 is formed together with through-holes formed in predetermined plural regions, by using aluminum or other metallic material, by thin film technology, such as sputtering and vapor deposition.

The heating resistance layer 33 opposite the through-holes is formed as heating element 23, and the heating elements 23 arranged on a straight line compose a heating element line 68. All thin film electrode layers 34 at one common side of the heating element line 68 are formed as a commonly connected thin film common electrode line 35, while the thin film electrode layers 34 at the other side are formed as individual electrodes 36 for every heating element 23. At the opposite end to the heating elements 23 of the thin film common electrode line 35, a plating layer 37 is formed along the overall length by solder plating or gold plating, and together with them, the common electrode line 24 is formed. In the remaining region of the thin film electrode layer 34 except for the plating layer 37, a wear resistance layer 38 of ceramics or other material is formed.

The plating layer 37 is connected by soldering or other means to one end of an L-shaped conductive member (hereinafter called conductive member) 40 possessing the shape as described below, being made of aluminum, copper or other metal material, by way of a solder layer 39. The remaining part of the conductive member 40 except for one end is adhered with an adhesive layer 41 to a side wall 42 of a cooling board 31 made of a light alloy material such as aluminum alloy, dropping in the thicknesswise direction of the substrate 22 and mounting the substrate 22, as shown in FIG. 1.

Figure 6:
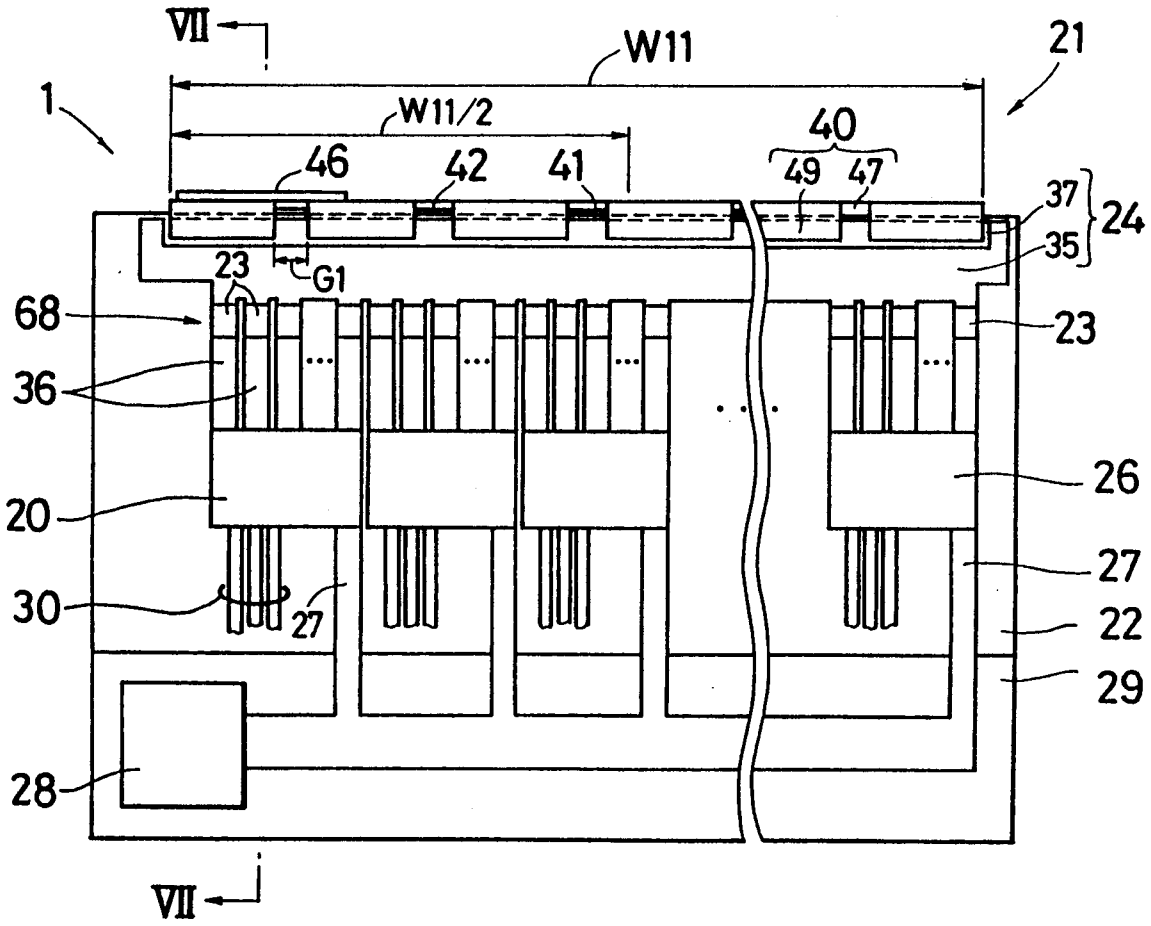
FIG. 6 is a plan view of the thermal head 21.
Figure 7:
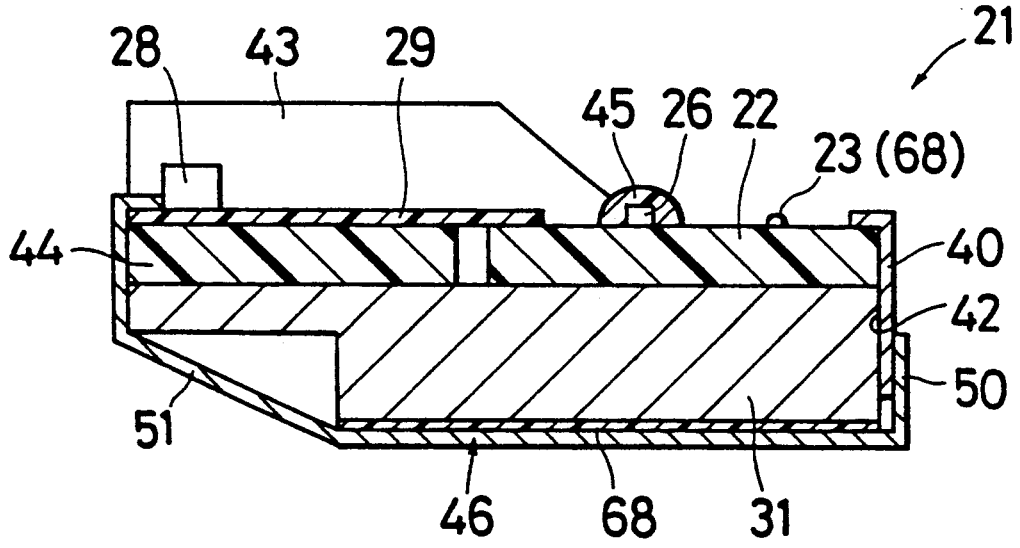
FIG. 7 is a sectional view of line VII—VII of cross section of FIG. 6.
Figure 8:
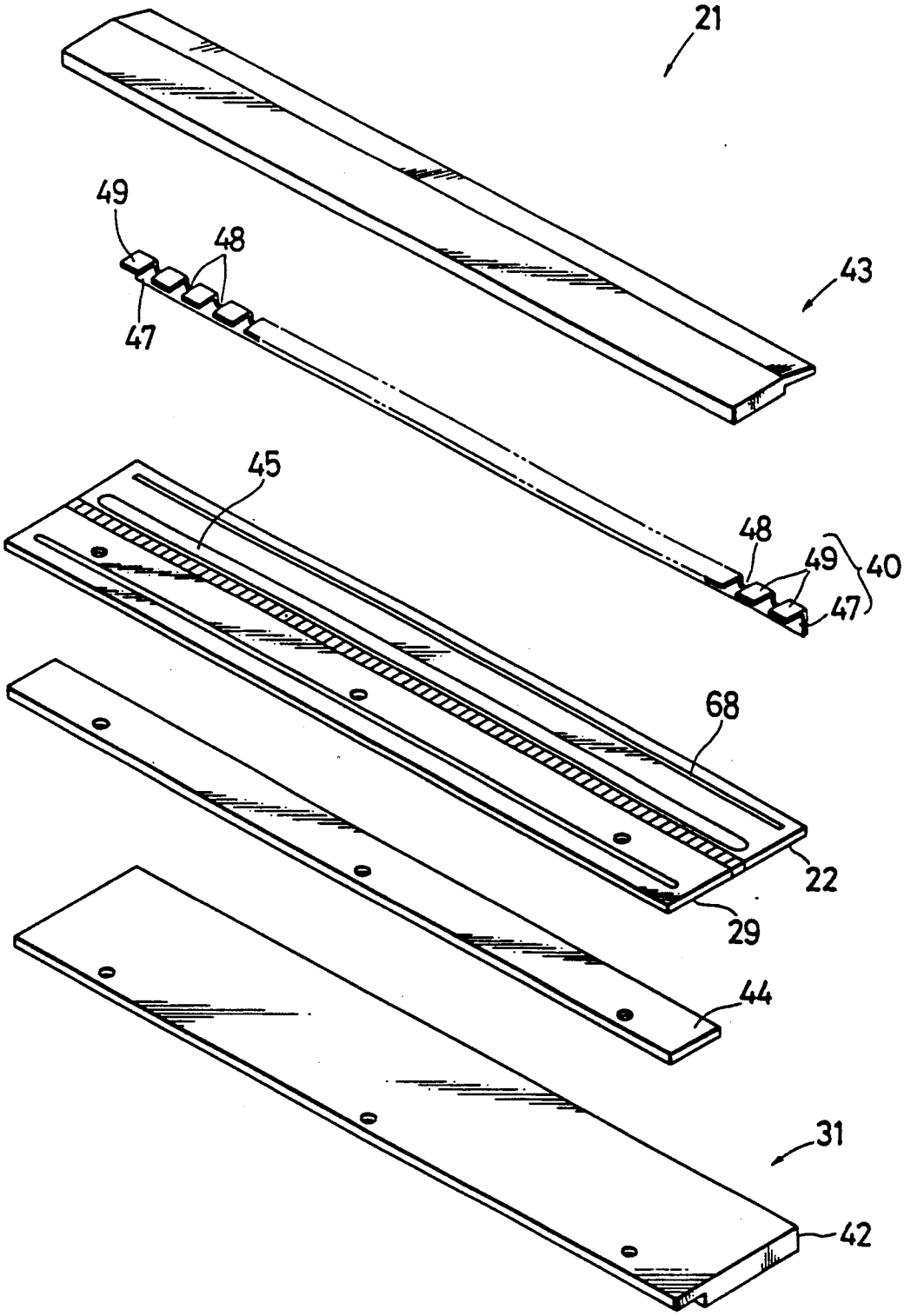
FIG. 8 is an exploded perspective view of the thermal head 21.

FIG. 6 is a plan view of the thermal head 21, FIG. 7 is a sectional view of line VII—VII of cross section of FIG. 6, and FIG. 8 is an exploded perspective view of the thermal head 21. Referring together to these drawings, the thermal head 21 is further described below. The vicinity of the flexible wiring substrate 29 of the thermal head 21 is covered with a cover 43, and is fixed to the cooling board 31 by way of a reinforcing board 44. The driving circuit elements 26 for selectively heating and driving the heating elements 23 of the heating element line 68 are covered with a protective member 45 with a relatively high hardness and a smooth surface property. Near the lower end of the conductive member 40, one end of a connecting conductor 46 is connected with solder or others, and the other end of the connecting conductor 46 is connected to a predetermined electrode of the flexible wiring substrate 29 through the bottom in which an electrically insulating film 68 of the cooling board 31 is formed, so that an electric current necessary for heating and driving the heating elements 23 is supplied.

The conductive member 40 comprises a rectangular plate 47 possessing a length W11 longer than the length of the heating element line 68 along the arranging direction, and plural connecting fingers 49 projecting from the edge opposite the heating element line 68 of the plate 47 to the heating element line 68 side and having slits 48 as blanking parts of gaps G1 mutually. The plate 47 is adhered to the side wall 42 of the cooling board 31 through an adhesive layer 41, and the connecting fingers 49 are bent at intermediate positions, and are soldered to the plating layer 37.

The connecting conductor 46 comprises a connecting part 50 to be connected to the conductive member 40, and a leading part 51 formed integrally with the connecting part 50 and connected to a power source electrode (not shown) of the flexible wiring substrate 29 at the opposite end. Therefore, the driving current of the heating elements 23 is supplied to each heating element 23 from the power source electrode of the flexible wiring substrate 29 through the connecting conductor 46, conductive member 40 and common electrode line 24.

In the conductive member 40 possessing the function of distributing the driving current supplied from the connecting conductor 46 to each heating element 23, the width of the electric line of the driving current flowing along the arrow B1 in FIG. 4 parallel to the arranging direction of the heating elements 23 is indicated by arrow W12 in FIG. 4. This width W12 may be approximately the sum of the thicknesses of the substrate 22 and cooling board 31, or may be further increased by extending the conductive member 40 to the bottom of the cooling board 31.

Figure 2:
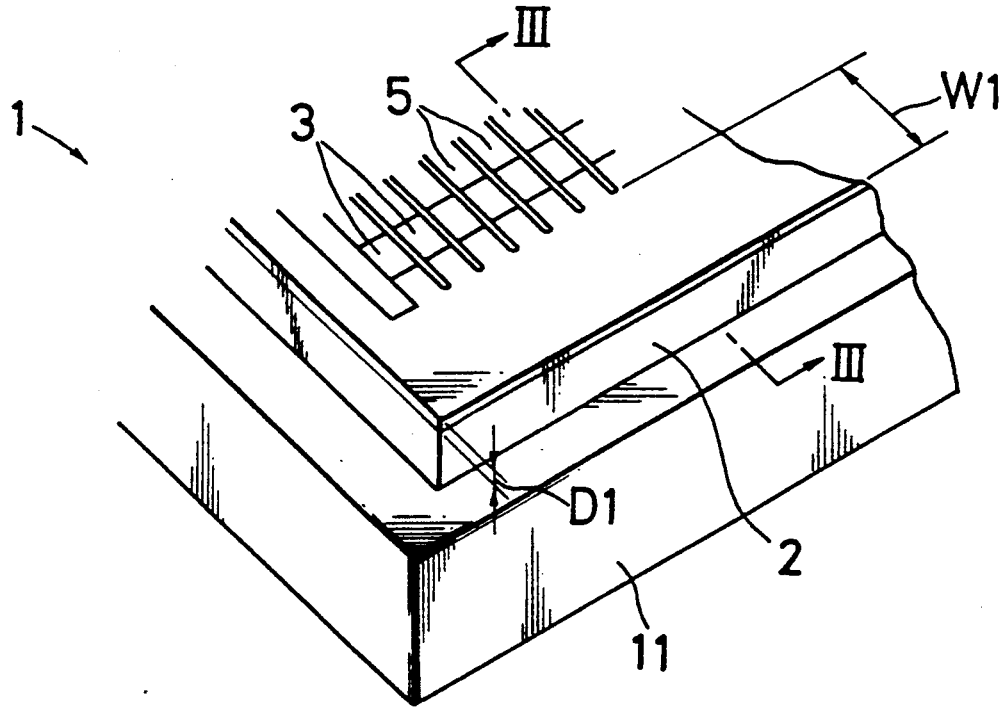
Fig. 2 Prior Art
FIG. 2 is a perspective view of the thermal head 1.
Figure 3:
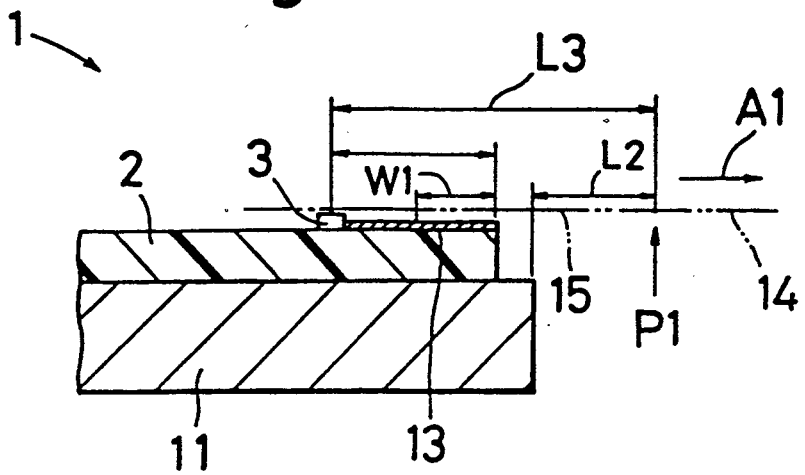
Fig. 3 Prior Art
FIG. 3 is a partial sectional view of the thermal head 1.

Suppose the film thickness D11 of the conductive member 40 is about the film thickness D1 (30 μm) of the common electrode line 4 in the prior art shown in FIG. 2, and that the resistivity is similarly 5 microohm-cm, when the thermal head 21 is printing on a thermal paper 53 of A4 size (232 mm in width) same as in the prior art, in order to keep the voltage drop of the conductive member 40 near the middle position of the thermal head 21 within 1.5% as mentioned in the prior art, the conductor resistance of the conductive member 40 must be set at about 15 milliohms or less. Therefore, the width W12 of the conductive member 40 in this embodiment may be about 13 mm in the same conditions as mentioned above.

Thus, the conductive member 40 of the embodiment may maintain such width 12 by extending along the side wall 42 of the cooling board 31 or from the side wall 42 to the bottom of the cooling board 31. As a result, it is possible to prevent uneven temperature of the heating elements 23 in the arranging direction, hence uneven contrast on the thermal paper 53 printed as being pressed by the thermal head 21 and platen roller 52. Incidentally, the conductive member 40 and the connecting conductor 46 may be formed integrally.

The conductive member 40 is, at its connecting finger 49, connected to the plating layer 37, that is, the thin film common electrode line 35, through the solder layer 39, and when the solder layer 39 is melted to press the connecting finger 49 to the plating layer 37, it is compressed in the thicknesswise direction, and the excess portion oozes out from the space between the connecting finger 49 and the plating layer 37.

Unless the slit 48 is formed in the conductive member 40, the excess portion of the solder layer 39 may be built up in the peripheral margin in the range surrounding the plating layer 37 of the conductive member 40, which may cause damage of the thermal paper 53 or jamming of paper as experienced in the prior art. In this embodiment, as the excess portion of the solder layer 39 oozes out into plural slits 48, and the oozing portion of the solder layer 39 is dispersed, and only a relatively small amount of excessive solder is put in each slit 48 and is completely absorbed within the slits 48. As a result, the shortcomings of the prior art may be eliminated.

Thus, the conductive member 40 basically extends in the thicknesswise direction of the cooling board 31, and is formed also to extend, if necessary, to the bottom of the cooling board 31, and therefore the dimension of the thermal head 21 is not elongated in the rightward direction of FIG. 5 unlike the prior art, which solves the conventional problem of increase of the length in the upper marginal region of the printing portion of the printing paper 53, so that the structure may be reduced in size while the cost is saved.

Figure 9:
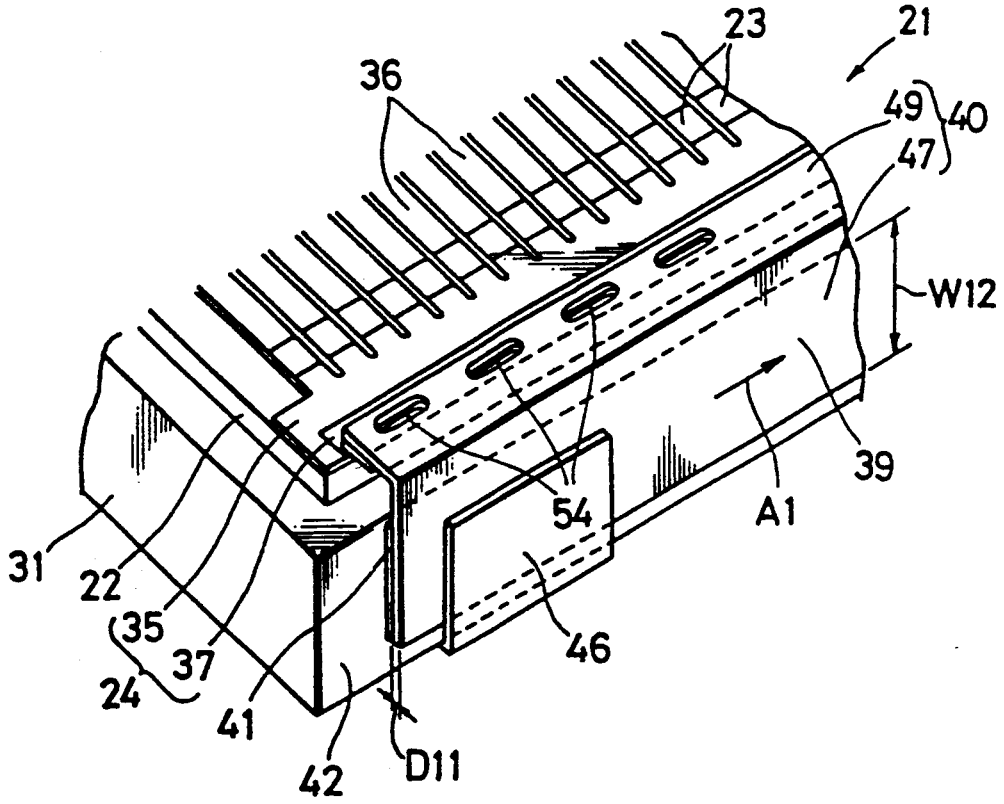
FIG. 9 is a perspective view of a second embodiment of the invention.

In the conductive member 40 of the thermal head 21 of this first embodiment, instead of the slits 48 for realizing such function as mentioned above, as shown in FIG. 9, the entire conductive member 40 is composed of a rectangular member, and through-holes 54 may be formed along the arranging direction of the heating elements 23 as plural blanking members in a range opposite to the plating layer 37. In thus composed second embodiment, the same effects as mentioned in the first embodiment may be obtained.

Figure 10:
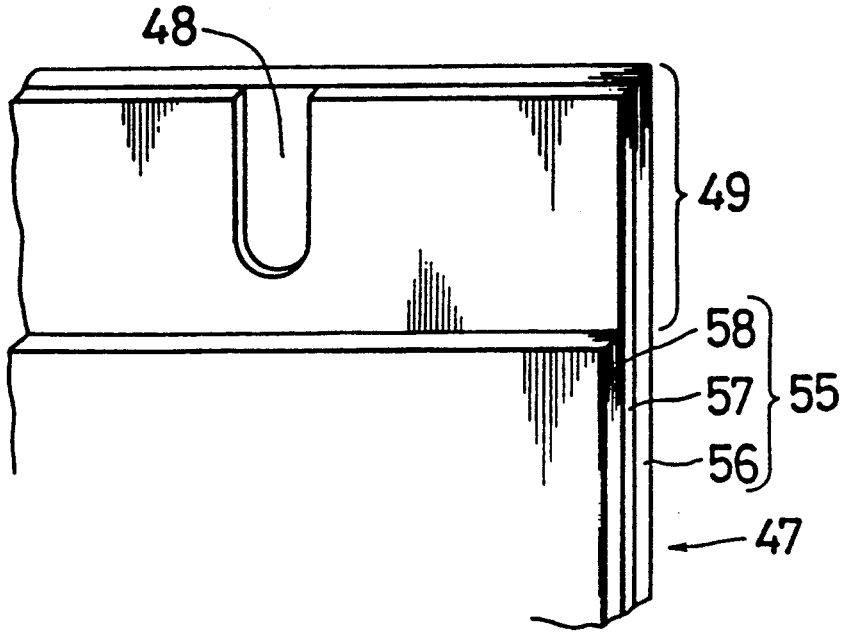
FIG. 10 is a perspective view of a flexible wiring substrate 55 of a third embodiment.
Figure 11:
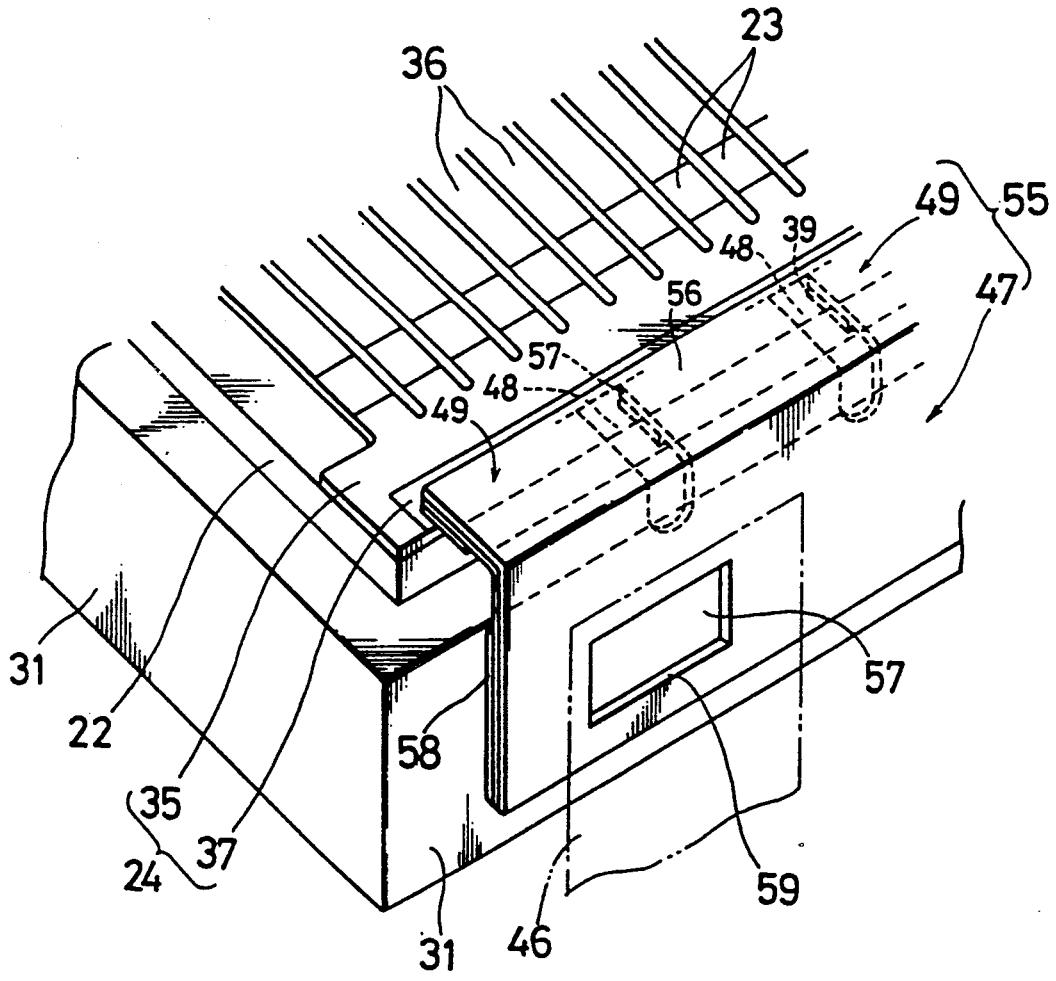
FIG. 11 is a perspective view near a substrate 22 in the same embodiment.

In the foregoing embodiments, the conductive member 40 is made of metallic thin film of, for example, aluminum and copper, but as shown in the development in FIG. 10 or perspective view in FIG. 11, a flexible wiring substrate 55 may be used instead. The flexible wiring substrate 55 is formed by forming a conductive layer 57 made of aluminum, copper or the like on the entire surface of a base film 56 made of an electrically insulating synthetic resin material such as polyimide resin and polyethylene terephthalate resin, and covering the entire surface with a cover film 58 made of a same material as, for example, the base film 56.

The cover film 58 is removed in the entire range confronting the plating layer 37, and slits 48 as shown in FIG. 4 are formed in the conductive layer 57. Accordingly, in the conductive layer 57, the same composition as in the connecting fingers 49 in the foregoing embodiments will be obtained. When connecting with the connecting conductors 46, the base film 56 at the connecting positions 56 is selectively removed to form connection windows 59, thereby exposing the conductive layer 57. The connecting conductors 46 are affixed by soldering or other means to the conductive layer 57 exposed through the connection windows 59.

By using thus composed flexible wiring substrate 55, not only the same effects as in the foregoing embodiments may be obtained, but also handling is very easy because only the necessary positions of the conductive film 57 are exposed through the base film 56 and cover film 58.

Figure 12:
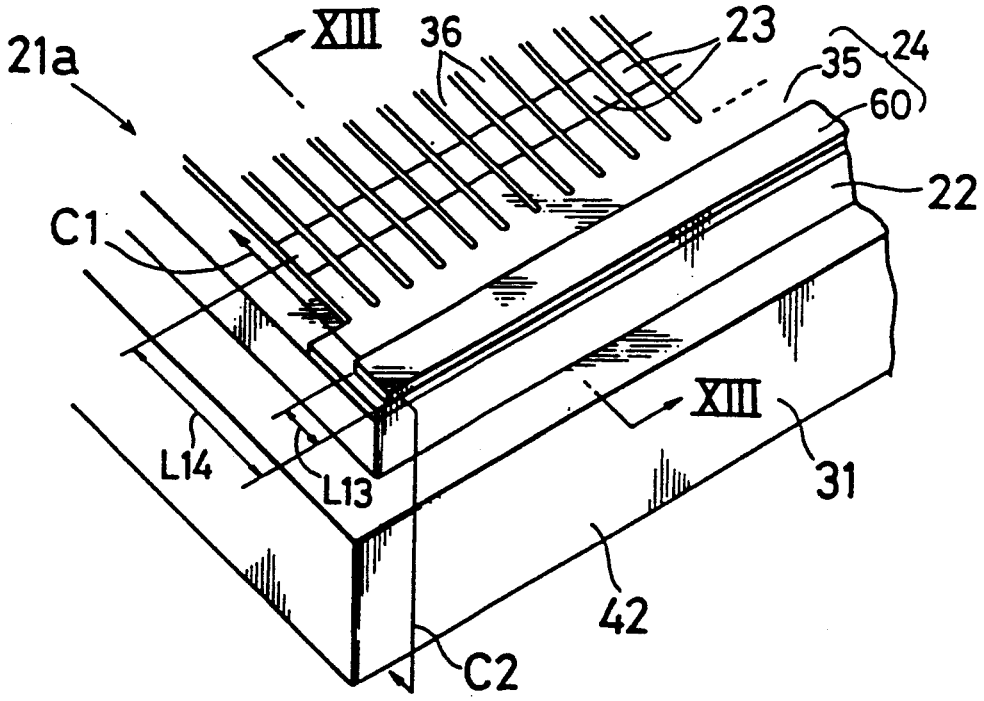
FIG. 12 is a perspective view of a thermal head **21*a* in a fourth embodiment.
Figure 13:
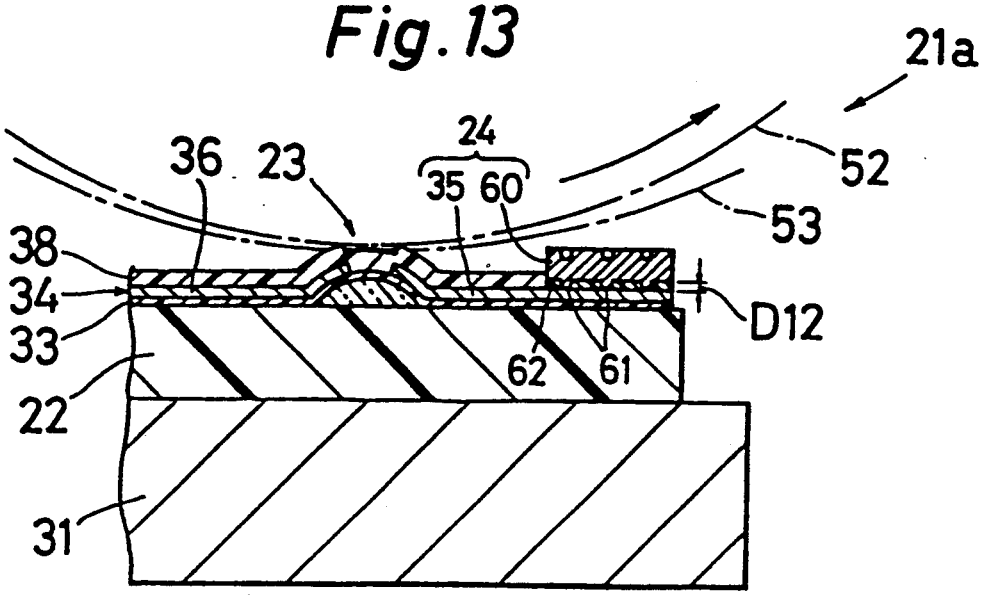
FIG. 13 is a sectional view of line III—III of cross section of FIG. 12, FIG. 14 and FIG. 15 are graphs for explaining the operation of the same embodiment.

FIG. 12 is a perspective view of a thermal head 21*a* in a fourth embodiment of the invention, and FIG. 13 is a sectional view of line XIII—XIII of cross section of FIG. 12. Referring to these drawings, this embodiment is described below. In the invention, this embodiment is similar to the foregoing embodiments, and the parts corresponding to those in the foregoing embodiments are identified with the same reference numbers. On a substrate 22 disposed on a cooling board 31, a heating element line 68 composed of plural heating elements 23, and common electrode line 24 and individual electrodes 36 connected thereto are provided. On the opposite side end against the heating element line of the common electrode line 24, a conductor layer 60 realized by, for example, a copper foil of 35 μm in layer thickness is mounted. At least on the surface of the conductor layer 60 opposing the thin film common electrode 35, embossing is processed, and multiple protrusions 61 of 35 μm to 100 μm with height of D12 are formed. That is, the conductor layer 60 contact with the thin film common electrode line 35 by way of protrusions 61. The conductor layer 60 is adhered to the thin film common electrode line 35 by way of an adhesion layer 62 intervening in the connecting parts 61.

The protrusions 61 are formed on the conductor layer 60 owing to the reason explained below. When the conductor layer 60 of which surface confronting the thin film common electrode line 35 is smooth is to be adhered to the thin film common electrode line 35 by way of the adhesion layer 62, these two surfaces may be electrically insulated by the adhesion layer 62. The protrusions 61 of the invention are to realize an electrical conduction securely against the thin film common electrode line 35 by penetrating through the adhesion layer 62.

Figure 14:
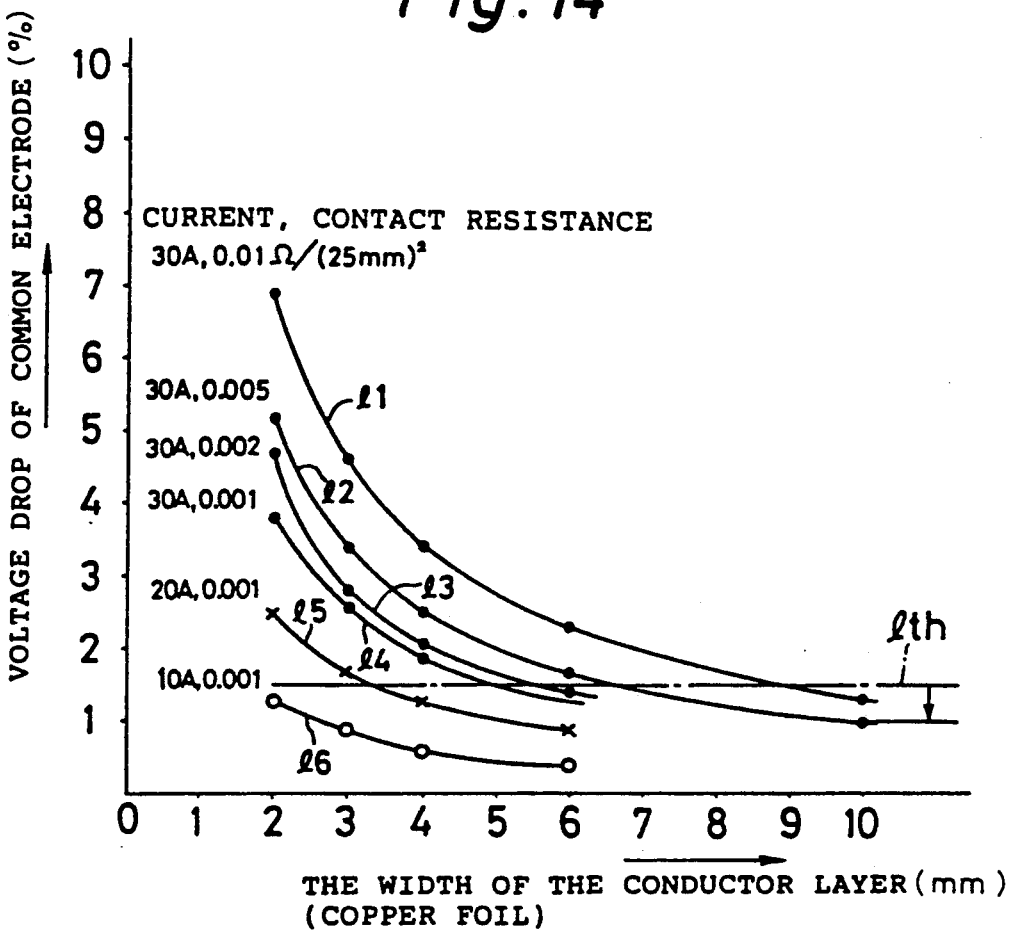

In such constitution of the embodiment, the thickness of the common electrode line 24 may be substantially expanded by using the conductor layer 60. FIG. 14 is a graph showing results of experiment by measuring the state of voltage drop near the middle position in the longitudinal direction in the thermal head 21*a* possessing a length W11 (232 mm) capable of printing on a thermal paper of A4 size, as explained in the foregoing embodiments. In this experiment, the combination of the adhesion contact resistance and the driving current between the conductor layer 60 and plating layer 37 is varied as shown in the diagram, and the change of the voltage drop when the width L13 of the conductor layer 60 is varied in each combination is indicated by lines l1 to l6. As explained in the foregoing embodiments, if the degree of voltage drop is 1.5% or less, the unevenness of contrast is not so obvious. Therefore, the range to be employed in this embodiment is the range below the reference line lth in FIG. 14.

Figure 15:
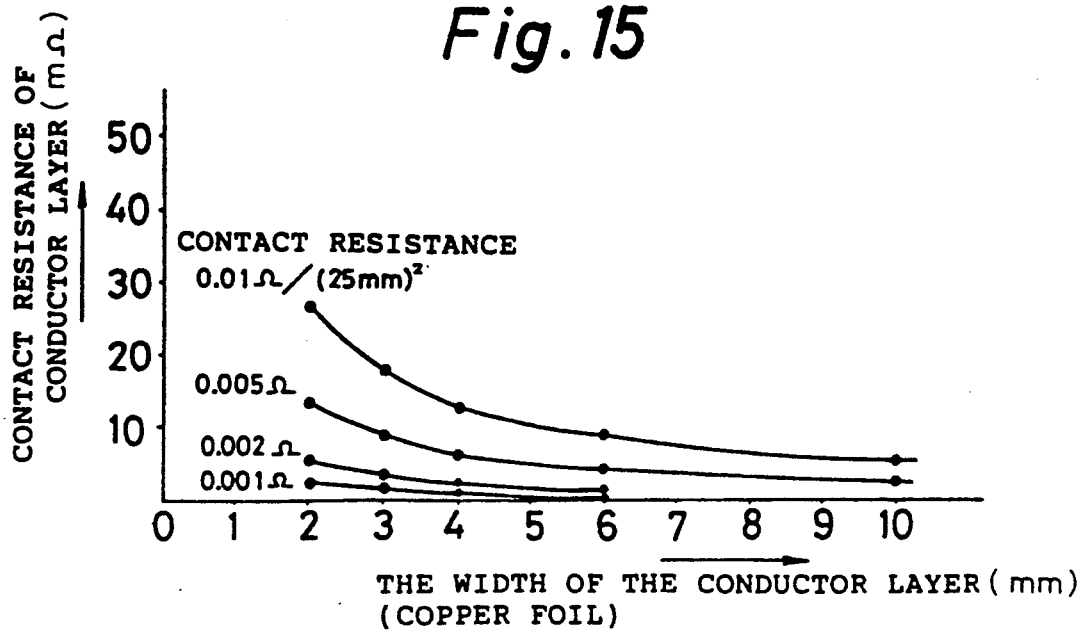

That is, when passing a current of 30A, in an electric line composed of thin film common electrode line 35 and conductor layer 60, as far as the contact surface contact resistance is 0.005 ohms/(25 mm)$^2$ or less, in particular, 0.001 ohm/(25 mm)$^2$, film thickness 35 μm, it is confirmed that the minimum value of the width L13 should be 5 mm. This size is similar to that in the first prior art, and the uneven printing may be eliminated without increasing the structural size of the thermal head 21*a*. Besides, as shown in FIG. 15, it has been known that the contact resistance becomes smaller as the width W13 becomes larger, and in this respect, too, this embodiment is advantageous. In this embodiment, also, the same effects as in the foregoing embodiments may be realized.

In an embodiment illustrated in FIG. 12, as a fifth embodiment, the both ends of the conductor layer 60 are extended in the direction of arrow C1 to connect with the power circuit element 28 as shown in FIG. 6, or else they may be extended from the side wall 42 of the cooling board 31 through the bottom of the cooling board 31 up to the connecting conductor 46 in FIG. 7 as indicated by arrow C2, thereby connecting with the power circuit element 28.

Figure 16:
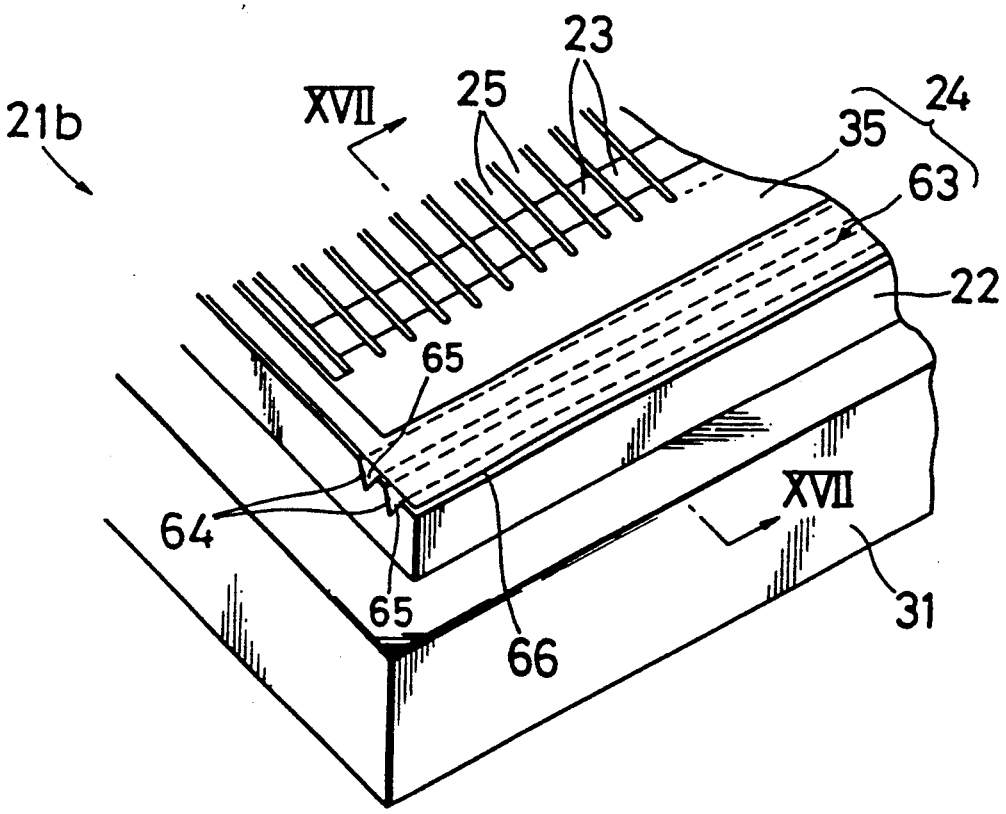
FIG. 16 is a perspective view of a thermal head 21*b* in a sixth embodiment.
Figure 17:
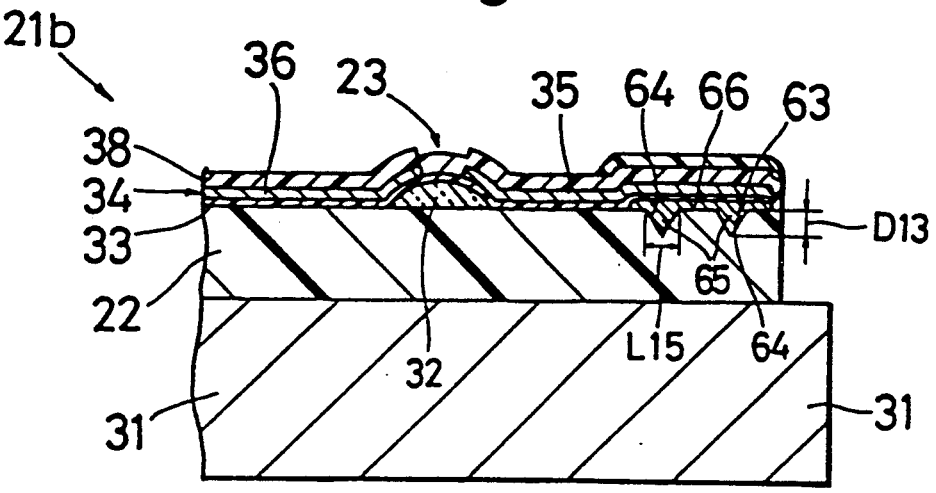
FIG. 17 is a sectional view of line VII—VII of cross section of FIG. 16.

FIG. 16 is a perspective view of the thermal head 21*b* in a sixth embodiment of the invention, and FIG. 17 is a sectional view of line XVII—XVII of cross section of FIG. 16. This embodiment is described below by referring to these drawings. This embodiment is similar to the foregoing embodiments, and the parts in the embodiment corresponding to those in the foregoing embodiments are identified with the same reference numbers. What is of note in this embodiment is as follows. In the foregoing embodiments, prior to forming the conductive member 40 shown in FIG. 4 or the conductor layer 60 shown in FIG. 12 on the substrate 22, for example, the thin film electrode layer 34 shown in FIG. 5 is selectively formed nearly on the entire surface of the substrate 22, and the individual electrodes 36 and thin film common electrode line 35 are formed simultaneously. By contrast, in this embodiment, prior to forming the thin film electrode layer 34, a thick film common electrode line 63 is formed by thick film technology such as screen printing on the substrate 22.

Moreover, on the substrate 22, one or plural grooves 64 having, for example, a V-shaped section vertical to the longitudinal direction are formed parallel to the arranging direction of the heating elements 23. Therefore, the thick film common electrode line 63 formed on the substrate 22 comprises, in this embodiment in the grooves 64, two protrusions 65 and a flat plate part 66 exposed on the surface of the substrate 22.

In this embodiment, on the substrate 22 forming such thick film common electrode line 63, heating resistance element layer 33, thin film electrode layer 34 with layer thickness of about 1 μm, and wear resistance layer 38 same as in the foregoing embodiments are formed.

Also in the thermal head 21*c* having such constitution, by the protrusions 65, the thick film common electrode line 63 is substantially increased in the film thickness as compared with the common electrode line 4 in the prior art shown in FIG. 2. That is, supposing the width L15 of the groove 64 to be 2 mm and the depth D13 to be 0.2 mm, as far as the size of the thermal head 21*b* of the embodiment corresponds to the thermal paper 53 of A4 size same as in the foregoing embodiments, the resistance near the middle position in the longitudinal direction of the thick film common electrode line 63 is $$5 \times 10^{-6} \times \frac{11.6\ \text{cm}}{0.2\ \text{cm} \times 0.02\ \text{cm}} = 14.5\ \text{milliohms} \qquad (2)$$

Therefore, it is possible to realize such a resistance as to prevent occurrence of uneven contrast when printing on the recording paper 52 in the thermal head 21*b*. In such embodiment, too, the same effects as in the foregoing embodiments may be achieved.

In this embodiment, furthermore, the protrusions 65 for substantially increasing the film thickness of the thick film common electrode line 63 is formed within the grooves 64 in the substrate 22. As a result, the thick film common electrode line 63 is prevented from increasing in the film thickness in the bulged state on the surface of the substrate 22, so that paper jamming and other troubles in printing action of the thermal paper 53 may be prevented.

Figure 18:
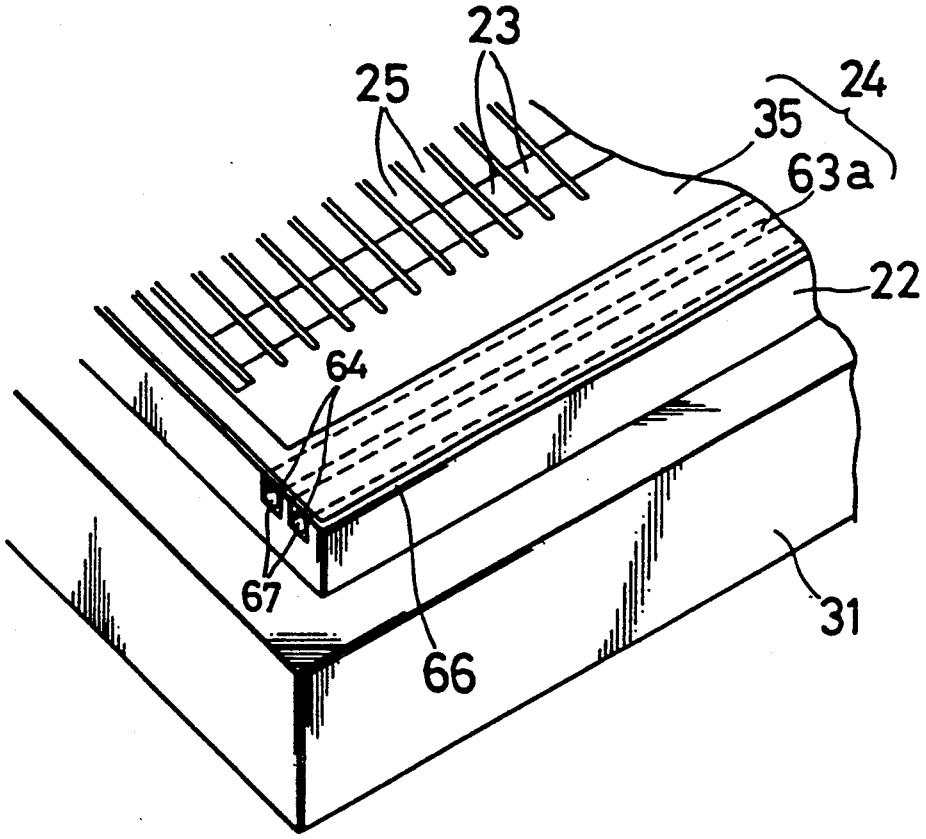
FIG. 18** is a perspective view of a seventh embodiment.

The sectional shape vertical to the longitudinal direction of the grooves 64 in the above embodiment is not limited to V-shaped, but U-shape or other shape may be formed. The protrusions 65 are formed integrally with the flat plate part 66 on the substrate 22, thereby forming the thick film common electrode line 63. Still more, as shown in FIG. 18 as a seventh embodiment, a thick film common electrode line 63a may be formed by burying a wire 67 in the groove 64 formed in the substrate 22, and forming a flat plate part 66 thereon by thick film technology such as screen printing. In such embodiment, too, the same effects as in the foregoing embodiments may be attained.

Thus, in these embodiments, while preventing occurrence of uneven contrast in printing by thermal head, the structure of the thermal head may be reduced in size, and the manufacturing cost and running cost may be saved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head provided with a first surface having an edge, and a second surface extending from the edge of the first surface, the thermal head comprisign:

an electrically insulating substrate;

a plurality of heating elements supported by the substrate;

a plurality of individual electrodes, each individual electrode being connected to a respective heating element;

a common electrode line commonly connected with each heating element of the plurality of heating elements;

an L-shaped electrically conductive member having a first portion extending adjacent to the first surface and a second portion extending adjacent to the second surface, the first portion of the L-shaped conductive member defining a plurality of blanking parts; and a layer of hot melt conductor material disposed between the first portion of the L-shaped conductive member and the common electrode line for electrically coupling the first portion of the L-shaped conductive member to the common electrode line, wherein excess hot melt conductor material from the layer flows into the plural blanking part.

2. A thermal head as claimed in claim 1, wherein the first portion of the L-shaped conductive member comprises a plate, and wherein the blanking parts comprise apertures provided in the plate.

3. A thermal head as claimed in claim 2, wherein the second surface is substantially perpendicular to the first surface.

4. A thermal head as claimed in claim 1, wherein the first portion of the L-shaped conductive member comprises a plurality of electrically conductive connecting fingers arranged adjacent to each other, each connecting finger being spaced apart from an adjacent one of the connecting fingers, and wherein the plurality of blanking parts comprise a plurality of gaps provided between the spaced apart connecting fingers.

5. A thermal head as claimed in claim 4, wherein the second surface is substantially perpendicular to the first surface.

6. A thermal head as claimed in claim 1, wherein the second surface is substantially perpendicular to the first surface.

7. A thermal head as claimed in claim 1, wherein the hot melt conductor material comprises solder.

8. A thermal head provided with a first surface having an edge, and a second surface extending from the edge of the first surface, the thermal head comprising:

a plurality of heating elements;

a plurality of individual electrodes, each individual electrode being connected to one side of a respective heating element;

a common electrode line commonly connected with another side of each heating element of the plurality of heating elements;

a conductive member having a first electrically conductive portion extending adjacent the first surface and a second electrically conductive portion extending adjacent the second surface, the first electrically conductive portion having a plurality of blanking parts; and a layer of hot melt conductor material disposed between the first conductive portion and the common electrode line for electrically coupling the first conductive portion to the common electrode line, wherein excess hot melt conductor material from the layer flows into the blanking parts.

9. A thermal head as claimed in claim 8, wherein the first conductive portion comprises a plurality of connecting fingers, each connecting finger being spaced apart from an adjacent one of the connecting fingers by a gap, and wherein the plurality of blanking parts comprises the gaps provided between the connecting fingers.

10. A thermal head as claimed in claim 8, wherein the first conductive portion comprises a plate having a plurality of apertures therein, and wherein the plurality of blanking parts comprises the apertures provided in first conductive portion.

11. A thermal head as claimed in claim 8, wherein the hot melt conductor material comprises solder.

12. A thermal head comprising:

an electrically insulating substrate;

a heating element line composed of plural heating elements arranged on the electrically insulating substrate;

a common electrode line commonly connected to one side of the heating element line;

individual electrodes respectively connected to the other side of the heating element line;

an L-shaped electrically conductive bracket attached to the common electrode line in the longitudinal direction, the L-shaped conductive bracket having first and second legs disposed substantially perpendicular to each other; and a layer of solder disposed between the first leg of the bracket and the common electrode line.

13. A thermal head comprising:

an electrically insulating substrate;

a heating element line composed of plural heating elements arranged on the electrically insulating substrate;

a common electrode line commonly connected to one side of the heating element line;

individual electrodes respectively connected to the other side of the heating element line;

an L-shaped electrically conductive member having one side attached to the common electrode line in the longitudinal direction and a second side extending substantially perpendicular to said one side, the L-shaped conductive member defining plural blanking parts along its longitudinal direction; and a layer of solder disposed between the L-shaped conductive member and the common electrode line, wherein a portion of the solder is allowed to flow into the blanking parts of the L-shaped conductive member.

14. A thermal head provided with a first surface having an edge, and a second surface extending from the edge of the first surface, the thermal head comprising:

a plurality of heating elements disposed adjacent the first surface;

a plurality of individual electrodes, each individual electrode being connected to one side of a respective heating element;

a common electrode line commonly connected with another side of each heating element of the plurality of heating elements;

an L-shaped electrically conductive member having first and second legs extending substantially perpendicular to each other, the first leg extending adjacent the first surface and a second leg extending adjacent the second surface, the first leg having a plurality of openings therein; and a layer of solder disposed between the first leg and the common electrode line for electrically coupling the first leg to the common electrode line, wherein excess solder from the layer flows into the openings in the first leg.

15. A method of making a thermal head, the method comprising the steps of:

providing a substrate with a first surface having an edge, and a second surface extending from the edge of the first surface;

arranging a plurality of heating elements adjacent the first surface;

connecting a plurality of individual electrodes to the heating elements such that each individual electrode is connected to one side of a respective heating element;

connecting a common electrode line commonly with another side of each heating element of the plurality of heating elements;

arranging an L-shaped electrically conductive member adjacent the common electrode line, the L-shaped conductive member having first and second legs extending substantially perpendicular to each other, the first leg extending adjacent the first surface and a second leg extending adjacent the second surface, the first leg having a plurality of openings therein;a nd electrically coupling the first leg and the common electrode line with solder between the first leg and the common electrode line, wherein excess solder flows into the openings in the first leg.

* * * * *